US006786796B2

(12) United States Patent
Suto

(10) Patent No.: US 6,786,796 B2
(45) Date of Patent: Sep. 7, 2004

(54) RADIO-CONTROLLED TWO-WHEELED VEHICLE TOY

(75) Inventor: Shohei Suto, Tokyo (JP)

(73) Assignee: Taiyo Kogyo Co., Ltd., Tokyo (JP)

( * ) Notice: Subject to any disclaimer, the term of this patent is extended or adjusted under 35 U.S.C. 154(b) by 0 days.

(21) Appl. No.: 10/619,207

(22) Filed: Jul. 14, 2003

(65) Prior Publication Data

US 2004/0116212 A1 Jun. 17, 2004

(30) Foreign Application Priority Data

Nov. 22, 2002 (JP) ..... 2002-338757

(51) Int. Cl.[7] ..... A63H 17/16; A63H 17/18; A63H 17/21

(52) U.S. Cl. ..... 446/440; 446/456; 446/462

(58) Field of Search ..... 446/440, 454, 446/456, 457, 462, 465

(56) References Cited

U.S. PATENT DOCUMENTS

| | | | | |
|---|---|---|---|---|
| 4,201,011 A | * | 5/1980 | Cook | 446/440 |
| 4,309,841 A | * | 1/1982 | Asano | 446/440 |
| 4,342,175 A | * | 8/1982 | Cernansky et al. | 446/440 |
| 4,966,569 A | | 10/1990 | Asano | |
| 5,368,516 A | * | 11/1994 | Hoeting et al. | 446/288 |
| 5,820,439 A | * | 10/1998 | Hair, III | 446/233 |
| 6,095,891 A | * | 8/2000 | Hoeting et al. | 446/440 |
| 6,482,069 B1 | * | 11/2002 | Tilbor et al. | 446/440 |
| 6,517,408 B1 | * | 2/2003 | Rehkemper et al. | 446/462 |
| 6,682,394 B2 | * | 1/2004 | Tilbor et al. | 446/440 |

FOREIGN PATENT DOCUMENTS

| | | | | |
|---|---|---|---|---|
| EP | 0 694 323 | | 1/1996 | |
| GB | 2119266 A | * | 11/1983 | A63H/29/20 |
| GB | 2130495 A | * | 6/1984 | A63H/17/00 |
| JP | 2002-200368 | | 7/2002 | |

* cited by examiner

*Primary Examiner*—Derris H. Banks
*Assistant Examiner*—Ali Abdelwahed
(74) *Attorney, Agent, or Firm*—Jordan and Hamburg LLP

(57) ABSTRACT

A radio-controlled two-wheeled vehicle toy in which the number of parts is reduced by simplifying the structure and traveling stability is improved. The toy includes a main body, a front fork portion rotatably mounted so that the traveling direction can be changed via an inclined caster axis by a steering control portion provided in a front side of the main body, a front wheel mounted to the front fork portion, a travel driving portion having a driving motor mounted to a rear side of the main body via a rear wheel shock absorbing portion, a rear wheel mounted to the travel driving portion of the driving portion case, a flywheel for stabilizing travel integrally provided in the rear wheel, a receiving circuit for radio-controlling the direction and speed, and a battery supplying electric power to the steering control portion and the driving portion.

20 Claims, 5 Drawing Sheets

RADIO-CONTROLLED TWO-WHEELED VEHICLE TOY

BACKGROUND OF THE INVENTION

1. Field of the Invention

The present invention relates to a radio-controlled two-wheeled vehicle toy having a mechanism capable of realizing a stable traveling.

2. Description of the Related Art

Conventionally, attention has been paid to a radio-controlled traveling toy such as a bicycle, a motorcycle or the like, and various proposals have been made for its traveling stability. For example, there has been proposed a radio-controlled bicycle having a structure that a flywheel is arranged within a crank shaft area of the bicycle, and is rotated by an independent motor from a driving motor (for example, refer to Japanese Patent Application Laid Open Publication No. 2002-200368) In this radio-controlled bicycle, the structure is made such that a stability and a maneuverability during an operation are achieved by a gyroscopic effect caused by the rotation of the flywheel.

However, in the conventional structure in which the flywheel provided within the crank shaft area of the bicycle is rotated by the independent motor different from the driving motor, the structure for rotating the flywheel is complex, the number of the parts is increased, a manufacturing cost is made high, and an electric power consumption is increased, whereby there is a risk that a service life of a battery is shortened. Further, within the crank shaft area, there is a case that it is hard to use the flywheel generating the gyroscopic effect on the basis of a large outer diameter, for the reason of limitation in a size of the arranging space. Further, in the conventional radio-controlled bicycle, no problem is generated in traveling on a flat road surface, however, in the case that the road surface has an irregularity, there is a risk that a traveling stability is deteriorated by an impact applied therefrom.

SUMMARY OF THE INVENTION

The present invention is made by taking the issues mentioned above into consideration, and an object of the present invention is to provide a radio-controlled two-wheeled vehicle toy in which the number of parts can be reduced by a simple structure and traveling stability can be improved.

In order to achieve the object mentioned above, in accordance with a first aspect of the present invention, there is provided a radio-controlled two-wheeled vehicle toy comprising:

- a two-wheeled vehicle main body;
- a front fork portion rotatably mounted so that a traveling direction can be changed via an inclined caster axis by a steering control portion provided in a front side of the two-wheeled vehicle main body;
- a front wheel mounted to the front fork portion via a front wheel shock absorbing portion;
- a driving portion case accommodating a travel driving portion having a driving motor mounted to a rear side of the two-wheeled vehicle main body via a rear wheel shock absorbing portion;
- a rear wheel mounted to the travel driving portion of the driving portion case;
- a flywheel for stabilizing a traveling integrally provided in the rear wheel;

- a receiving circuit for radio-controlling the steering control portion and the travel driving portion; and
- a battery supplying an electric power to each of the portions. Since the flywheel for stabilizing the traveling is integrally provided in the rear wheel, and the front wheel shock absorbing portion and the rear wheel shock absorbing portion are respectively provided in the front wheel and the rear wheel, it is possible to reduce the number of the parts by a simple structure and it is possible to improve a traveling stability.

In accordance with a second aspect of the present invention, the steering control portion is constituted by a rotation of an electromagnetic coil arranged in a center portion of a ring-shaped magnet. It is possible to easily control a direction change by the ring-shaped magnet and the electromagnetic coil.

In accordance with a third aspect of the present invention, an arm portion extended in a vertical direction is integrally formed on one side surface in a front side of the case accommodating the electromagnetic coil and the ring-shaped magnet, a caster axis is provided by a backward tilting angle toward a direction orthogonal to the extending direction in a leading end side of the arm portion, and the rotation of the electromagnetic coil is transmitted to the front fork portion by an oscillating lever mounted to the arm portion in a freely oscillating manner. Since the case accommodating the electromagnetic coil and the ring-shaped magnet having a heavy weight is positioned in a side of a lower portion in a center portion of the two-wheeled vehicle main body by the arm portion, it is possible to improve a traveling stability on the basis of making a center of gravity low.

In accordance with a fourth aspect of the present invention, the steering control portion is constituted by a motor driving to which a torque control by a centrifugal clutch is applied. The steering control portion can be achieved by the motor driving.

In accordance with a fifth aspect of the present invention, the flywheel integrally provided in the rear wheel is a member made of a metal material which is provided in an outer periphery of a wheel rim and an inner side of tire and formed in a ring shape. It is possible to make the outer diameter of the flywheel large so as to generate a great gyroscopic effect.

In accordance with a sixth aspect of the present invention, the flywheel integrally provided in the rear wheel is a member made of a metal material in an entire of a wheel rim. It is possible to make the structure of the flywheel simple so as to generate the further great gyroscopic effect.

DESCRIPTION OF THE PREFERRED EMBODIMENTS

Figure 1:
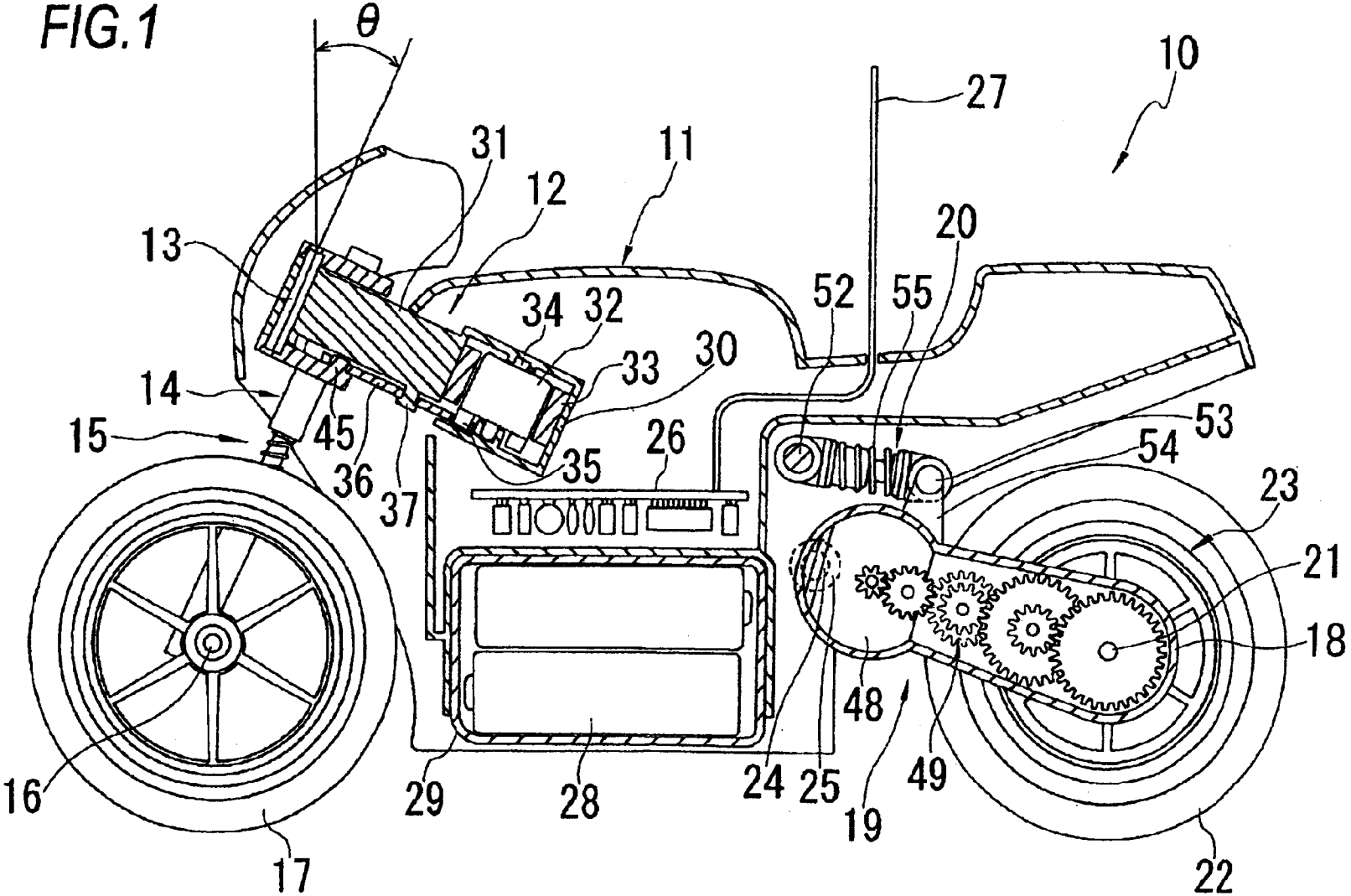
FIG. 1 is a cross sectional view of a radio-controlled two-wheeled vehicle toy in accordance with an embodiment of the present invention.
Figure 2:
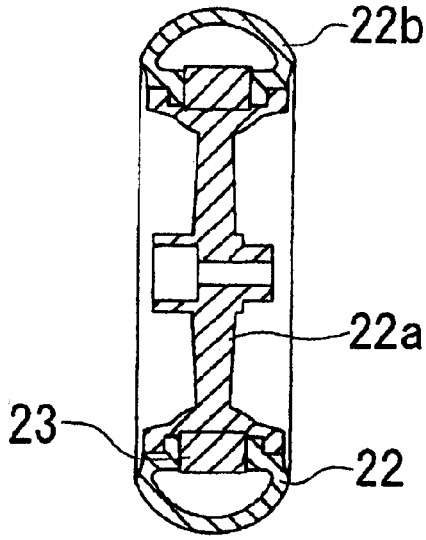
FIG. 2 is a cross sectional view of a rear wheel in accordance with the embodiment of the present invention in a direction along an axle.
Figure 3:
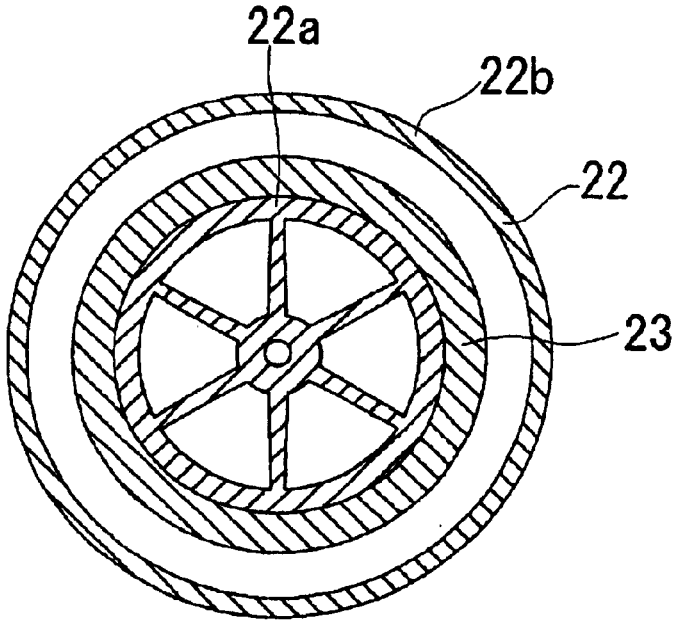
FIG. 3 is a cross sectional view of the rear wheel in accordance with the embodiment of the present invention in a direction orthogonal to the axle.
Figure 4:
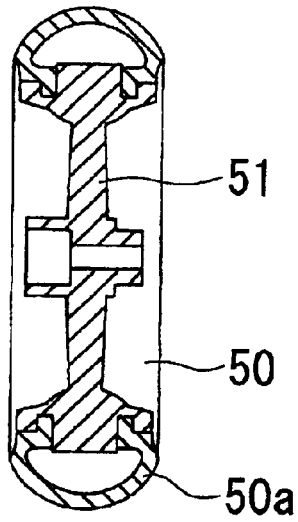
FIG. 4 is a cross sectional view of a rear wheel in accordance with another embodiment of the present invention in a direction along an axle.
Figure 5:
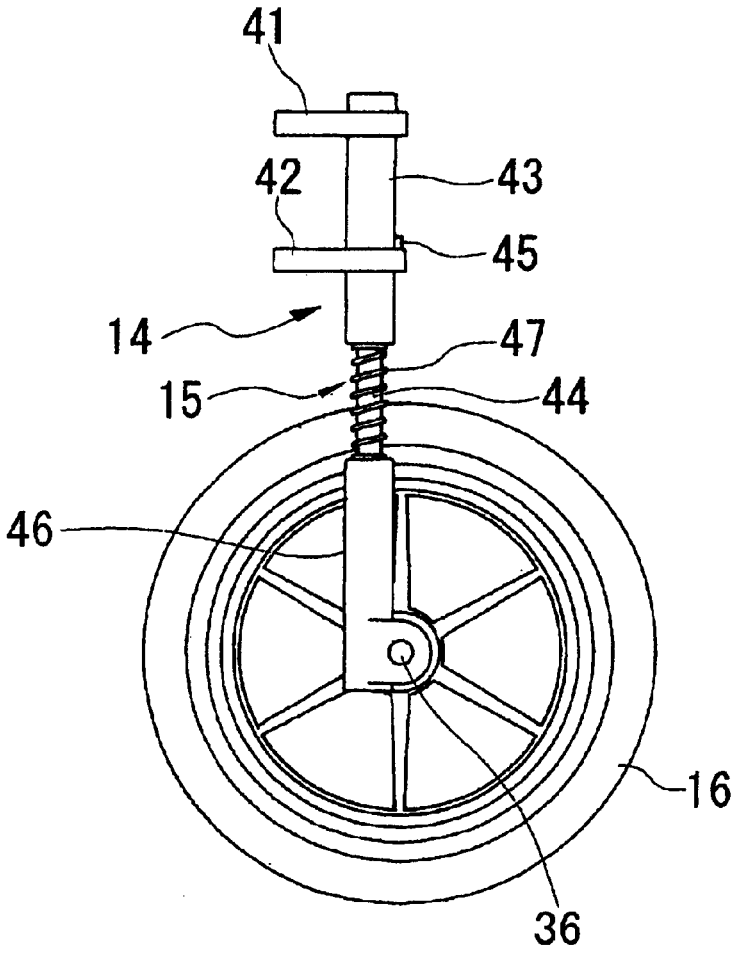
FIG. 5 is a side view of a front wheel and a front fork portion in accordance with the embodiment of the present invention.
Figure 6:
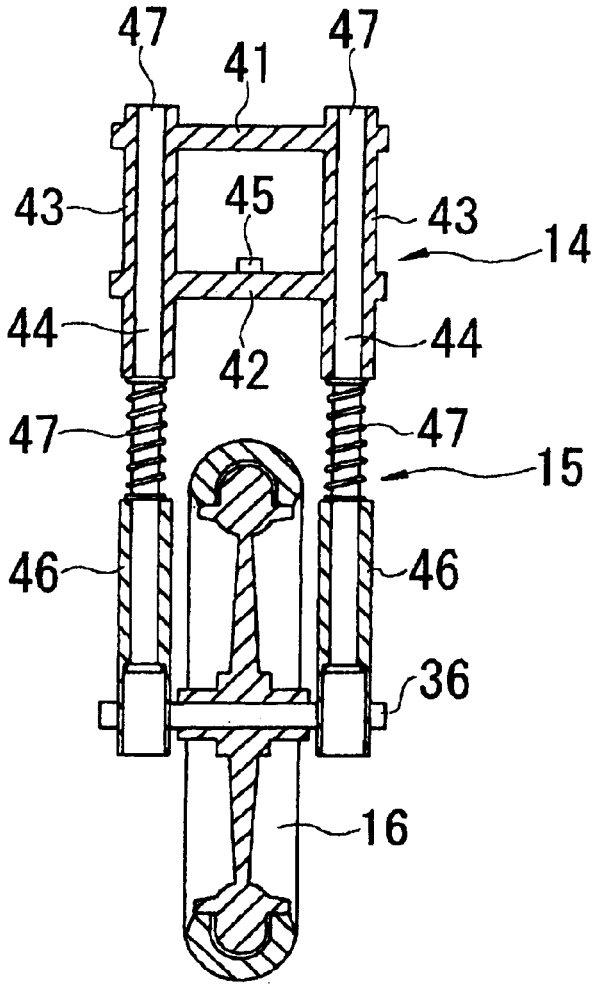
FIG. 6 is a cross sectional view of the front wheel and the front fork portion in accordance with the embodiment of the present invention.

A description will be in particular given below of the present invention on the basis of an illustrated embodiment. FIGS. 1 to 6 are views describing a radio-controlled two-wheeled vehicle toy in accordance with an embodiment of the present invention, in which FIG. 1 is a cross sectional view of a radio-controlled two-wheeled vehicle toy, FIG. 2 is a cross sectional view of a rear wheel in a direction along an axle, FIG. 3 is a cross sectional view of the rear wheel in a direction orthogonal to the axle, FIG. 4 is a cross sectional view of a rear wheel in accordance with another embodiment in a direction along an axle, FIG. 5 is a side view of a front wheel and a front fork portion, and FIG. 6 is a cross sectional view of the front wheel and the front fork portion.

In these views, a radio-controlled two-wheeled vehicle toy 10 is constituted by a two-wheeled vehicle main body 11, a steering control portion 12 provided in a front side of the two-wheeled vehicle main body 11, a front fork portion 14 rotatably mounted to the steering control portion 12 via an inclined caster axis 13 so that a traveling direction can be changed, a front wheel 17 mounted to the front fork portion 14 via a front wheel shock absorbing portion 15, a driving portion case 18 mounted to a rear side of the two-wheeled vehicle main body 11 via a rear wheel shock absorbing portion 20, a rear wheel 22 mounted to the driving portion case 18, a travel driving portion 19 provided within the driving portion case 18 and driving the rear wheel 22, a travel stabilizing flywheel 23 integrally provided in the rear wheel 22, a receiving circuit 26 for radio controlling the steering control portion 12 and the travel driving portion 19, a battery 28 supplying an electric power to each of the portions, and the like.

The two-wheeled vehicle main body 11 is, for example, made of a molding material such as a plastic or the like, and is formed in a toy shape to resemble a motorcycle. A front side of the two-wheeled vehicle main body 11 is formed in a shape for mounting the steering control portion 12 and the front fork portion 14, and a rear side thereof is formed in a shape for covering an upper portion of the driving portion case 18 to which the rear wheel 22 is mounted. Further, the two-wheeled vehicle main body 11 is structured such that a space for attaching a battery case 29 accommodating the battery 28 is formed in a lower side approximately in a center portion thereof, the receiving circuit 26 is mounted to an upper portion of the space, and an antenna 27 connected to the receiving circuit 26 can be led out to an external portion from an upper side. Further, it is preferable that a skid (not illustrated in FIG. 1) constituted by auxiliary wheels or the like is provided in a lower side of a center portion of the two-wheeled vehicle main body 11, whereby it is possible to prevent the two-wheeled vehicle main body 11 from falling down when the two-wheeled vehicle main body 11 is stationary or travels at a low speed. Accordingly, it is possible to easily restart the two-wheeled vehicle main body 11 as it is supported by the front wheel 17, the rear wheel 22, and the auxiliary wheels or the like.

The steering control portion 12 is integrally formed with an arm portion 31 which is extended comparatively long in a vertical direction to a front side surface of a case 30 accommodating a ring-shaped magnet 33 constituted by an electromagnetic coil 32, and a permanent magnet is provided with the caster axis 13 in a leading end side of the arm portion 31 so as to be directed in a direction orthogonal to the extending direction, and is mounted to a front side of the two-wheeled vehicle main body 11 so that the caster shaft 13 forms a backward tilting angle (θ), for example, about 23 to 27 degrees with respect to a vertical line. Accordingly, the case 30 accommodating the electromagnetic coil 32 and the ring-shaped magnet 33 which have comparatively heavy weights are positioned somewhat in a lower side so as to be directed to a side of the center portion of the two-wheeled vehicle main body 11 by the backward tilting angle of the caster axis 13 and the arm portion 31, thereby realizing a low center of gravity. The electromagnetic coil 32 is rotatably arranged in a center portion of the ring-shaped magnet 33 via an axis 34 within the case 30, and an engaging piece 35 is formed at a position deflecting from the ring-shaped magnet 33 in a peripheral edge portion in one side (a lower side) and is structured and arranged to be rotated on the basis of a signal for changing directions applied from the receiving circuit 26. The rotation of the electromagnetic coil 32 is transmitted to the front fork portion 14 described in detail later by an oscillating lever 36, and is structured and arranged to be rotated around the caster axis 13. The oscillating lever 36 is formed in an elongated plate shape, an approximately center portion thereof is mounted to an axis 37 protruding from a lower portion side of the arm portion 31 in a freely oscillating manner, and is structured such that an engaging piece 35 of the electromagnetic coil 32 is engaged with an engagement portion **36*a* formed in a U-shape on a side of one end portion, and a projection portion 45 provided in the front fork portion 14 is engaged with an engagement portion 36*b* formed in a U-shape on a side of another end portion in the same manner. That is, a control current is supplied from the receiving circuit 26 on the basis of the direction changing signal received via the antenna 27, the electromagnetic coil 32 is rotated within the ring-shaped magnet 33, and the oscillating lever 36 is oscillated on the basis of the rotation so as to change the direction of the front fork portion 14**.

The front fork portion 14 is structured such that a pair of supporting pipe portions 43 are integrally molded by a plastic material or the like to the left and right of a pair of parallel upper plate portion 41 and lower plate portion 42 formed approximately in a triangular shape, supporting axes 44 are mounted to the supporting pipe portions 43 respectively so as to protrude in a side of lower portions, a pair of holding pipe portions 46 for mounting the front wheel 17 or axle 16 are attached to the supporting axes 44 in a side of lower end portions respectively so as to be slidable in a vertical direction. As a result, a pair of holding pipe portions 46 do not come off from the supporting axes 44. Compression springs 47 constituting the front wheel shock absorbing portion 15 are interposed to the supporting axes 44 portions between lower end portions of the supporting axes 44 and upper end portions of the holding pipe portions 46. A strength and a stroke of the compression spring 47 can be optionally set. Further, a projection portion 45 engaged with the engagement portion **36*b* of the oscillation lever 36 mentioned above is formed on a central upper surface of the lower plate portion 42. The holding pipe portions 46 are arranged so as to clamp the axle 16, and the front wheel 17 is rotatably mounted to the axle 16 which is mounted over and between the respective end portions. Further, the front fork portion 14 to which the front wheel 17 is mounted is structured such that an angle of incline of the supporting axes 44 is parallel to the caster axis 13, and top portions of the triangle shape of the upper plate portions 41 and the lower plate portion 42 are rotatably attached to both end portions of the caster axis 13. That is, the front wheel 17 or axle 16 is mounted to the holding pipe portions 46 slidably mounted to the lower end portions of a pair of supporting axes 44 of the front fork portion 14 via the front wheel shock absorbing portion 15 in such a manner as to be capable of shock absorbing an impact applied from a ground surface side during the traveling, and the front fork portion 14 is rotatably attached to the caster axis 13 on the basis of the oscillation of the oscillating lever 36**.

The driving portion case 18 is formed in a shape of an elongated container accommodating a driving motor 48, a gear train 49 and the like constituting the travel driving portion 19. The driving motor 48 is driven by a driving signal output from the receiving circuit 26, and the gear train 49 is constructed by a plurality of meshed gears arranged so as to reduce a speed of rotation of the driving motor 48. The rear wheel 22 is mounted to an axle 21 provided in a final stage gear of the gear train 49 on a side surface of the driving portion case 18. An axis portion 24 rotatably supported by a bearing portion 25 formed in a rear portion side of the two-wheeled vehicle main body 11 is formed on an outer side surface of the driving portion case 18 in a side in which the driving motor 48 is received, and a supporting portion 54 for being mounted to a rear wheel shock absorbing portion 20 is provided near the axis portion 24. This rear wheel shock absorbing portion 20 is constituted by a member expanded and contracted by a compression spring 55 which is rotatably mounted to an axis portion 52 of the two-wheeled vehicle main body 11 in a side of one end portion and is rotatably mounted to an axis portion 53 of the supporting portion 54 of the driving portion case 18 in a side of another end portion. A strength and a stroke of this compression spring 55 can be optionally set. That is, the rear wheel 22 is mounted to a side surface in a side of another end portion of the driving portion case 18 rotatably mounted to the rear portion side of the two-wheeled vehicle main body 11 in a side of one end portion, and the driving portion case 18 is supported by the rear wheel shock absorbing portion 20, whereby it is possible to shock absorbing the impact that the rear wheel 22 is applied from the ground surface during the traveling.

The rear wheel 22 is structured, as shown in FIGS. 2 and 3, such that a tire 22*b* is mounted to an outer periphery of a wheel rim 22*a* mounting the axle 21 to a center, and a flywheel 23 constituted by a member such as a ring-shaped metal material or the like is integrally provided in an outer periphery of the wheel rim 22*a* and an inner side of the tire 22*b*. This flywheel 23 is structured such as to secure a traveling stability on the basis of a gyroscopic effect generated by rotating at the same speed as that of the rear wheel 22. Further, as another rear wheel 50 for generating the gyroscopic effect mentioned above, the structure may be made such that a flywheel 51 is obtained by forming an entire of the wheel rim by a member such as a metal material or the like, and a tire 50*a* is mounted to a periphery thereof.

The battery 28 corresponds to a portion for supplying an electric power to the receiving circuit 26, the driving motor 48, the electromagnetic coil 32 of the steering control portion 12 and the like, is received in the battery case 29, and is detachably mounted to the lower portion side of the center portion in the two-wheeled vehicle main body 11.

Figure 7:
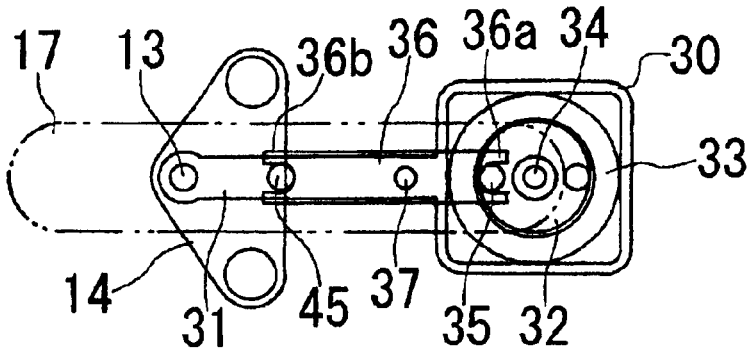
FIG. 7 is a view showing a state in which the front wheel in accordance with the embodiment of the present invention moves in a straight going direction.
Figure 8:
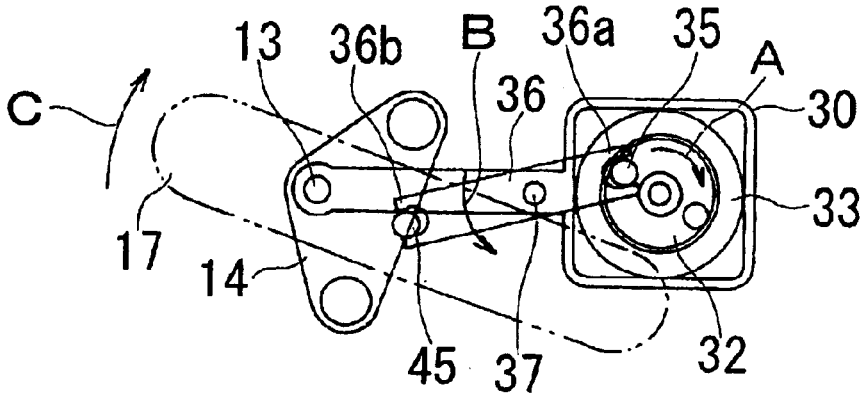
FIG. 8 is a view showing a state in which the wheel in accordance with the embodiment of the present invention is directed from the straight going direction to one direction.

Next, a description will be given of an operation of the radio-controlled two-wheeled vehicle toy 10 in accordance with the present invention. FIGS. 7 and 8 are views describing an operation of the steering control portion, in which FIG. 7 is a view showing a state in which the front wheel is driven in a straight going direction, and FIG. 8 is a view showing a state in which the wheel is directed to one direction from the straight going direction.

First, when the receiving circuit 26 receives a signal for starting the travel from a radio-controlled transmitter (not shown) via the antenna 27, the electric power is supplied to the driving motor 48 of the travel driving portion 19 within the driving portion case 18 from the battery 28 on the basis of the driving signal output from the receiving circuit 26 so as to rotate the driving motor 48, and the rotation of the driving motor 48 is reduced by the gear train 49 so as to be transmitted to the rear wheel 22. The two-wheeled vehicle toy starts traveling on the basis of the rotation of the rear wheel 22 and moves forward at a predetermined speed. Since the ring-shaped flywheel 23 simultaneously and integrally rotating with the rear wheel 22 is provided in this rear wheel 22, it is possible to secure a stability in traveling on the basis of a gyroscopic effect generated by the rotation. Further, in the steering control portion 12, since the case 30 accommodating the electromagnetic coil 32 and the ring-shaped magnet 33 constituted by the permanent magnet is mounted to the front side of the two-wheeled vehicle main body 11 via the comparatively long extended arm portion 31 so as to be inclined in the direction orthogonal to the backward tilting angle of the caster axis 13, the electromagnetic coil 32 and the ring-shaped magnet 33 which have comparatively heavy weights are positioned somewhat in a lower side so as to be directed to the side of the center portion of the two-wheeled vehicle main body 11 as a whole, and the battery 28 and the like are arranged in the side of the lower portion of the center portion of the two-wheeled vehicle main body 11. Accordingly, it is possible to intend to make the center of gravity of the steering control portion 12 low as a whole, and the traveling stability can be improved.

Next, the signal for changing the moving direction from the transmitter is received via the antenna 27, the control signal for changing the direction is applied to the electromagnetic coil 32 from the receiving circuit 26, and the electromagnetic coil 32 rotates in a fixed direction (for example, a direction A, as shown in FIG. 8) within the ring-shaped magnet 33. The leading end side of the oscillating lever 36 provided in the arm portion 31 is rotated in a direction B in accordance with the rotation of the electromagnetic coil 32 in the direction A, and the side of the front fork portion 14 is rotated in a direction C via the caster axis 13, whereby the direction of the front wheel 17 mounted to the front fork portion 14 is changed, and the moving direction is changed. Further, since the front wheel 17 and the rear wheel 22 of the radio-controlled two-wheeled vehicle toy 10 are mounted to the two-wheeled vehicle toy 11 respectively via the front wheel shock absorbing portion 15 and the rear wheel shock absorbing portion 20, it is possible to shock absorb the impact applied on the basis of the irregularity of the road surface and the like during the traveling. Accordingly, it is possible to achieve a stable traveling. In this case, with respect to a brake in the present embodiment, it is possible to utilize a back electromotive force of the driving motor 48.

In the radio-controlled two-wheeled vehicle toy 10 having the structure mentioned above, it is possible to secure the traveling stability on the basis of the gyroscopic effect without arranging the conventional flywheel driven by the independent driving source by arranging the integrally rotating ring-shaped flywheel 23 in the rear wheel 22 or setting the whole of the wheel rim to the flywheel 51 as another rear wheel 50. Accordingly, it is possible to make the structure simple so as to easily manufacture the two-wheeled vehicle toy and it is possible to inexpensively manufacture the two-wheeled vehicle toy. Further, since no independent motor or the like is used for rotating the flywheel, it is possible to extend the service life of the battery 28. Since the outer diameters of the flywheels 23 and 51 can be made as same as that of the tire at the largest without requiring any particular arranging space by being integrally provided in the rear wheels 22 and 51, it is possible to generate a great gyroscopic effect and it is possible to improve the traveling stability. Further, in the steering control portion 12, since the case 30 accommodating the electromagnetic coil 32 and the ring-shaped magnet 33 is mounted to the two-wheeled vehicle main body 11 via the comparatively long extended arm portion 31 so as to be inclined in the direction orthogonal to the backward tilting angle of the caster axis 13, the electromagnetic coil 32 and the ring-shaped magnet 33 which have comparatively heavy weights are positioned somewhat in a lower side so as to be directed to the side of the center portion of the two-wheeled vehicle main body 11 as a whole, and the battery 28 and the like are arranged in the side of the lower portion of the center portion of the two-wheeled vehicle main body 11. Accordingly, it is possible to intend to make the center of gravity of the steering control portion 12 low as a whole, and the traveling stability can be improved. It is confirmed that the straight going property can be improved by setting the backward tilting angle of the caster axis 13 to a range between about 23 and 27 degrees, and it is possible to achieve the structure which can arrange the position of the case 30 accommodating the electromagnetic coil 32 and the ring-shaped magnet 33 in the side of the lower portion of the center portion of the two-wheeled vehicle main body 11, on the basis of the length of the arm portion 31 and the angle of incline by the caster axis 13. Further, since the front wheel 17 and the rear wheel 22 (the rear wheel 50) are mounted to the two-wheeled vehicle toy 11 via the front wheel shock absorbing portion 15 and the rear wheel shock absorbing portion 20 respectively, whereby it is possible to shock absorb the impact applied from the irregularity of the road surface or the like during the traveling and the stable traveling can be achieved.

Above, the description is given of an embodiment in which the two-wheeled vehicle main body 11 is formed in a toy shape resembling a motorcycle. However, the radio-controlled two-wheeled vehicle toy may be formed at least in a shape of a two-wheeled vehicle toy, for example, in a shape resembling a motorbike or a bicycle having no power source. Further, the structure of the rear wheels 22 and 50 can be optionally set and is not limited to the embodiment as far as the flywheels 23 and 51 are provided in the rear wheels 22 and 50 so as to integrally rotate therewith. The description is given of the structure rotated by the electromagnetic coil 32 arranged in the center portion of the ring-shaped magnet 33, with respect to the steering control portion 12, however, the steering control portion 12 can be also applied, for example, to a structure driven by a motor to which a torque control by a centrifugal clutch is applied. In the steering control portion 12 in accordance with the present embodiment, a length of the arm portion 31 can be optionally set in correspondence with the backward tilting angle of the caster axis 13 and the shape of the two-wheeled vehicle main body 11, and the oscillating lever 36 can be optionally set in correspondence with the shape of the arm portion 31.

Further, in the present embodiment, the description is given of the travel driving portion 19 on the basis of the embodiment in which the rotation of the driving motor 48 is reduced in speed by the gear train 49, however, the structure may be made such that the rotation of the driving motor 48 is reduced in speed by a pulley and a belt. Further, a sense of reality can be applied to the two-wheeled vehicle main body 11 by putting a rider doll or the like, and in this case, the antenna 27 can be received in an inner portion of the rider doll.

As described above, since the radio-controlled two-wheeled vehicle toy is provided with the two-wheeled vehicle main body, the front fork portion rotatably mounted so that the traveling direction can be changed via the inclined caster axis by the steering control portion provided in the front side of the two-wheeled vehicle main body, the front wheel mounted to the front fork portion via the front wheel shock absorbing portion, the driving portion case accommodating the travel driving portion having the driving motor mounted to the rear side of the two-wheeled vehicle main body via the rear wheel shock absorbing portion, the rear wheel mounted to the travel driving portion of the driving portion case, the flywheel for stabilizing the traveling integrally provided in the rear wheel, the receiving circuit for radio-controlling the steering control portion and the travel driving portion, and the battery supplying the electric power to each of the portions, it is possible to reduce the number of the parts by a simple structure and it is possible to improve a traveling stability.

What is claimed is:

1. A radio-controlled two-wheeled vehicle toy comprising:

a two-wheeled vehicle main body;

a steering control portion arranged on a front side of said main body;

a front fork portion rotatably mounted to said steering control portion so that a traveling direction is variable;

a front wheel mounted to said front fork portion;

a driving portion case mounted to a rear side of said main body;

a travel driving portion having a driving motor arranged in said driving portion case;

a rear wheel mounted to said travel driving portion of said driving portion case;

a flywheel integrally incorporated into said rear wheel such that it rotates at the same speed as said rear wheel, said flywheel being arranged to stabilize travel of said main body;

a receiving circuit arranged on said main body for radio-controlling said steering control portion and said travel driving portion; and a battery arranged on said main body for supplying electric power to said steering control portion and said travel driving portion.

2. The radio-controlled two-wheeled vehicle toy as claimed in claim 1, wherein said steering control portion comprises:

a ring-shaped magnet; and an electromagnetic coil rotatably arranged in a center portion of said ring-shaped magnet.

3. The radio-controlled two-wheeled vehicle toy as claimed in claim 2, further comprising:

a steering control portion case arranged to accommodate said ring-shaped magnet and said electromagnetic coil;

an arm portion integrally formed on a front side of said steering control portion case; and an oscillating lever having a first end and a second end and being mounted to said arm portion in a freely oscillating manner, said oscillating lever being rotatably connected at said first end to said front fork portion and rotatably connected at said second end to said electromagnetic coil such that rotation of said electromagnetic coil causes a reverse rotation of said front fork portion.

4. The radio-controlled two-wheeled vehicle toy as claimed in claim 1, wherein said steering control portion comprises:

a driving motor; and a centrifugal clutch arranged to apply controlled torque to said driving motor.

5. The radio-controlled two-wheeled vehicle toy as claimed in claim 1, wherein said rear wheel further comprises a wheel rim and a tire, said flywheel comprising an annular member arranged between and in contact with an outer periphery of said wheel rim and an inner side of said tire.

6. The radio-controlled two-wheeled vehicle toy as claimed in claim 1, wherein said flywheel comprises an entire wheel rim.

7. The radio-controlled two-wheeled vehicle toy as claimed in claim 1, wherein said battery is arranged in a low area near a center of said main body to provide a low center of gravity for said main body.

8. The radio-controlled two-wheeled vehicle toy as claimed in claim 1, further comprising a front wheel shock absorbing portion, said front wheel being mounted to said front fork portion via said front wheel shock absorbing portion.

9. The radio-controlled two-wheeled vehicle toy as claimed in claim 1, further comprising a rear wheel shock absorbing portion, said driving portion case being mounted to a rear side of said main body via said rear wheel shock absorbing portion.

10. The radio-controlled two-wheeled vehicle toy as claimed in claim 1, wherein said flywheel is ring-shaped.

11. The radio-controlled two-wheeled vehicle toy as claimed in claim 1, wherein said rear wheel comprises a wheel rim, said flywheel being ring-shaped and integrally connected to an outer periphery of said wheel rim.

12. The radio-controlled two-wheeled vehicle toy as claimed in claim 11, wherein said rear wheel further comprises a tire arranged around said wheel rim and said flywheel.

13. The radio-controlled two-wheeled vehicle toy as claimed in claim 12, wherein said flywheel is in contact with said wheel rim and said tire.

14. The radio-controlled two-wheeled vehicle toy as claimed in claim 1, wherein said flywheel constitutes a wheel rim for mounting said rear wheel to said main body.

15. The radio-controlled two-wheeled vehicle toy as claimed in claim 14, wherein said rear wheel further comprises a tire arranged around said flywheel.

16. The radio-controlled two-wheeled vehicle toy as claimed in claim 3, wherein a caster axis is formed perpendicular to a longitudinal direction of said arm portion on a leading end of said arm portion.

17. The radio-controlled two-wheeled vehicle toy as claimed in claim 16, wherein said caster axis is a backward tilting angle.

18. The radio-controlled two-wheeled vehicle toy as claimed in claim 3, wherein a caster axis is formed parallel to a longitudinal direction of said front fork portion.

19. The radio-controlled two-wheeled vehicle toy as claimed in claim 18, wherein said caster axis is a backward tilting angle.

20. The radio-controlled two-wheeled vehicle toy as claimed in claim 1, wherein said flywheel is made of metal.

* * * * *